US005497893A

United States Patent [19]

Mangone, Jr.

[11] Patent Number: 5,497,893

[45] Date of Patent: Mar. 12, 1996

[54] ENCLOSURE FOR CABLE CONNECTIONS

[76] Inventor: Peter G. Mangone, Jr., 28600 Buchanan Dr., Evergreen, Colo. 80439

[21] Appl. No.: 232,495

[22] Filed: Apr. 25, 1994

[51] Int. Cl.[6] ..... B65D 43/20

[52] U.S. Cl. ..... 220/3.8; 220/281; 220/326; 220/345

[58] Field of Search ..... 220/3.2, 346, 3.8, 220/281, 326, 345

[56] References Cited

U.S. PATENT DOCUMENTS

| | | | |
|---|---|---|---|
| 1,486,415 | 3/1924 | Casper | 220/346 |
| 3,289,085 | 11/1960 | Leland | 220/346 |
| 4,777,812 | 10/1988 | Haugen . | |
| 4,898,195 | 2/1990 | Sussman | 220/346 |
| 5,064,231 | 11/1991 | Mangone, Jr. . | |
| 5,082,137 | 1/1992 | Weinstein | 220/346 |
| 5,129,538 | 7/1992 | Bennett | 220/346 |

FOREIGN PATENT DOCUMENTS 376888 11/1994 United Kingdom .

*Primary Examiner*—Joseph M. Moy
*Attorney, Agent, or Firm*—Klaas, Law, O'Meara & Malkin

[57] ABSTRACT

A tamper-resistant enclosure for use in installing cable, such as a splitter for television cable, wherein a base plate is secured to a wall of a building and after a cable connection has been made a cover having an opening therein is attached to the base plate and wherein during the attachment of the cover a portion thereof is deformed over a projection from the base plate so that as the cover resiles the projection passes through the opening and a flange portion on the projection moves into contact with a portion of the cover surrounding the opening. Also, the projection has an opening extending therethrough to enable a portion of a tamper indicating sealing device may be passed therethrough.

12 Claims, 1 Drawing Sheet

ENCLOSURE FOR CABLE CONNECTIONS

FIELD OF THE INVENTION

This invention relates generally to the installation of cable, such as television cable, and more particularly to a tamper-resistant enclosure for certain cable connecting devices.

BACKGROUND OF THE INVENTION

In the installation of cable to a home or building, and more particularly to the installation of a splitter for television cable, it is customary to use an enclosure to provide for protection from the elements. Such an enclosure would comprise a base plate which is fastened to a wall and has means for supporting a splitter. The base plate has an upstanding wall which has a center opening for receiving the entering cable and other openings on either side of the center opening for providing passageways for cables leaving the splitter. After the cable connections have been made, a cover is attached to the base plate. While such an enclosure does protect the cable splitter, the cover may be removed and the cable splitter may be tampered with connections from the elements, it is subject to tampering since the cover can be readily removed.

BRIEF DESCRIPTION OF THE INVENTION

This invention provides a tamper-resistant enclosure for cable connections.

A prior art enclosure for cable connections, particularly for a splitter for television cable connections, has a base plate which is fastened to a wall. The base plate is spaced from the wall and has side and top edge portions. A bottom wall extends outwardly from the base plate and has openings formed therein for the passage of a cable into the enclosure and of cables out of the enclosure. A support for a splitter also extends outwardly from the base plate. After the cable connections have been made, a cover is attached to the base plate. The cover comprises a face plate and a depending U-shaped side wall. The inner surface of the U-shaped sidewall has grooves for receiving the side and top edge portions of the base plate as the cover is slid over the base plate so that the bottom wall covers the opening of the U-shaped sidewall. However, the cover may be readily removed by sliding it in the opposite direction.

In a preferred embodiment of this invention, locking means are provided to resist relative sliding movement between the base plate and the cover after the cover has been installed on the base plate. One portion of the locking means comprises an opening formed in the face plate and a projection on the bottom wall that passes through the opening in the face plate. Retaining means are provided to retain the projection in place after it has passed through the opening and the retaining means comprise a flange portion in contact with a portion of the face plate defining the opening therein. Another portion of the locking means comprises first abutment means on the inner surface of the cover in contact with second abutment means on the bottom wall. Also, an opening extends through the projection so that a lock can be installed therethrough.

The enclosure of this invention is installed by first securing the base plate on a wall. The desired cable connections are made. The cover of this invention is formed from a deformable material, such as polyethylene or other materials having similar characteristics. The cover is moved over the base plate so that the side edges of the base plate are in the grooves in the sidewall of the cover. A surface of the projection is inclined so that as the edge of the face plate contacts the surface of the projection, the portion of the face plate is deformed outwardly as the edge moves over the projection. As the opening moves over the projection, the deformed portion of the face plate resiles so that the projection passes through the opening. A flange portion in the projection cooperates with a portion of the face plate defining the opening to retain the projection in place. Also, while the portion of the face plate is being moved and deformed, first abutment means on the inner surface of the cover move over second abutment means on the bottom wall so that after the portion of the face plate has resiled, the first and second abutment means function to resist the removal of the cover. Integral reinforcing means between the base plate and the bottom wall resist movement of the bottom wall as the face plate is moved over the projection. Also, the base plate can be formed from a material more rigid than the cover. The projection has an opening therethrough so that a lock or a tamper indicating sealing device may be passed therethrough to hold the cover in place. Whenever it is desired to inspect the interior of the enclosure, the lock or a tamper indicating sealing device is removed and the face plate is deformed so that the cover may be slid over the base plate and be removed.

BRIEF DESCRIPTION OF THE DRAWING

A preferred embodiment of the invention is illustrated in the drawing in which.

DETAILED DESCRIPTION OF THE INVENTION

Figure 1:
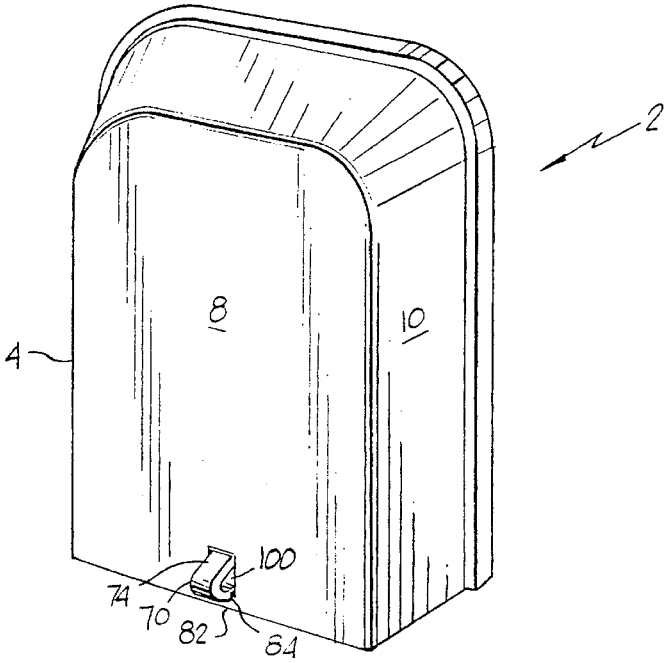
FIG. 1 is a perspective view of the enclosure of this invention.
Figure 2:
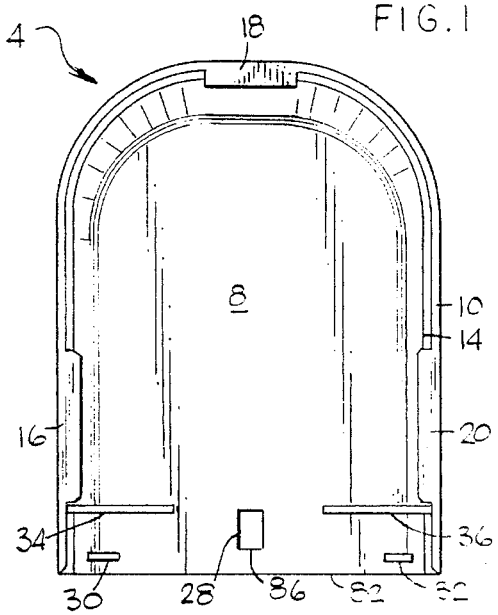
FIG. 2 is a bottom plan view of the cover of the enclosure.
Figure 4:
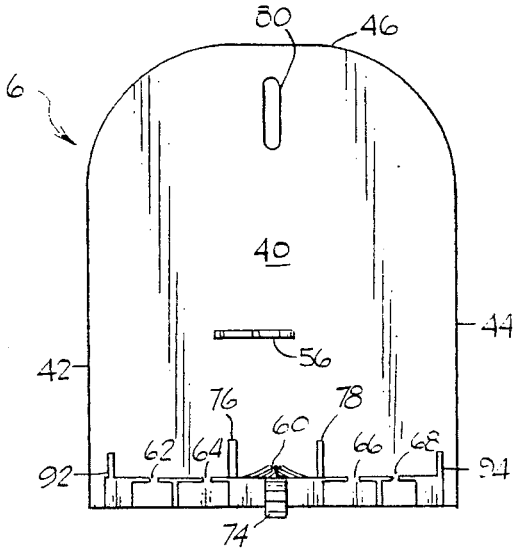
FIG. 4 is a top plan view of the base plate of the enclosure.
Figure 3:
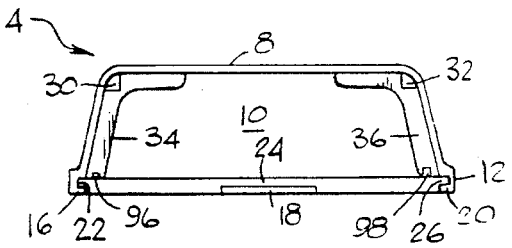
FIG. 3 is an end elevational view of the cover.
Figure 5:
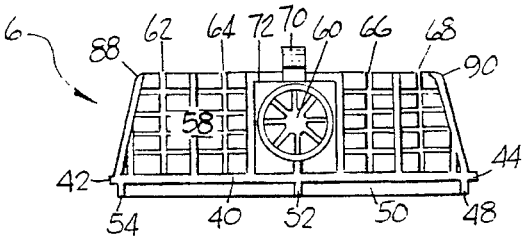
FIG. 5 is an end elevational view of the base plate.

An enclosure 2 is illustrated in the drawing and comprises a cover 4, FIGS. 2 and 3, and a base plate 6, FIGS. 4 and 5.

The cover 4 comprises a face plate 8 and an integral generally U-shaped sidewall 10. A portion 12 of the sidewall 10 projects outwardly so as to form an inner flange portion 14. A plurality of spaced apart walls 16, 18 and 20 project inwardly from the portion 12 and cooperate with the inner flange portion 14 to form a plurality of grooves 22, 24 and 26. An opening 28 is formed in the face plate 8. Two spaced apart abutments 30 and 32 are integral with portions of the sidewall 10 and face plate 8. The cover 4 is formed from a deformable material such as polyethylene or other materials having similar characteristics. Two reinforcing ribs 34 and 36 are integral with and extend inwardly from the face plate 8 and the sidewall 10. The reinforcing ribs 34 and 36 add rigidity to the sidewall 10 and restrain the flexing thereof.

The base plate 6 has a base portion 40 having side edge portions 42 and 44 and a top edge portion 46. Reinforcing flanges 48, 50, 52 and 54 extend from one side of the base portion 40. A support 56 for a splitter (not shown) extends from the other side of the base portion 40. A wall 58 also extends from the other side of the base portion 40 and has a central opening 60 for passage of an incoming cable (not shown) and side openings 62, 64, 66 and 68 for passage of outgoing cables (not shown). A projection 70 extends from a central portion 72 and has an inclined surface 74. Reinforcing ribs 76 and 78 are integral with portions of the base portion 40 and wall 58 and function to add rigidity to the wall 58. The base plate 40 may be formed from a material similar to the cover 4 or may be formed from a more rigid material. Two reinforcing ribs 92 and 94 project from the base portion 40 and are located to fit into slots 96 and 98 when the cover 4 is in place on the base plate 6 to restrain movement of the sidewall 10.

The enclosure 2 is installed by first securing the base plate 6 on the wall of a building using a headed fastener (not shown) passing through an opening 80 in the base portion 40. A splitter (not shown) with the desired cable connections is attached to the support 56. The cover 4 is then positioned so that the side edge portions 42 and 44 are in the grooves 20 and 22. The cover 4 is then slid over the side edge portions 42 and 44 until the leading edge portion 82 of the face plate 8 contacts the inclined surface 74 of the projection 70. A sufficient force is applied to the cover 4 to move the leading edge portion 82 over the inclined surface 74. Since the face plate 8 is formed from a deformable material, it deforms outwardly to permit the movement of the cover 4. When the opening 28 has moved over the projection 70, the face plate 8 resiles so that the projection 70 passes through the opening 28. A flange portion 84 on the projection 70 moves into contact with a portion 86 of the face plate 8 defining the opening 28 to retain the projection 70 in place. As the face plate 8 is deformed, the abutments 30 and 32 pass over the wall 58. When the face plate 8 resiles, the abutments 30 and 32 move to a location to contact abutments 88 and 90 on the wall 58 to assist in restraining the sliding movement of the cover 4 in the opposite direction.

The projection 70 has an opening 100 extending therethrough so that the link of a tamper indicating lock, such as that described in U.S. Pat. No. 5,064,231, may be passed through the opening 86 and secured to the body portion of the tamper indicating lock or other type of tamper indicating sealing device to prevent the removal of the cover 4. Whenever it is desired to inspect the interior of the enclosure, the tamper indicating lock or other type of tamper indicating sealing device is removed and the face plate 8 is deformed to move abutments 30 and 32 out of contact with the abutments 88 and 90 so that the cover 4 can be slid over the projection 70 and the base plate 6 and be removed.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. An enclosure comprising:

a base plate adapted to be mounted on a wall of a building;

a cover attaching means on said base plate and on said cover for attaching said cover on said base plate for sliding movement of said cover relative to said base plate;

said cover having a face plate and an integral U-shaped sidewall so as to form a cavity between said base plate and said cover;

a substantially rigid wall integral with said base plate and located to close the open end portion of said U-shaped sidewall;

locking means to resist relative sliding movement between said base plate and said cover;

at least a portion of said locking means comprising said face plate having an opening formed therein;

a relatively stationary projection integral with said substantially rigid wall and passing through said opening to resist relative sliding movement between said cover and said base plate;

said cover being formed from a deformable material so that a portion of said face plate surrounding said opening may be deformed outwardly to permit movement thereof over said projection and then resile so that said projection will pass through said opening; and said substantially rigid wall resisting movement thereof in the direction of movement of said face plate against the force applied by said face plate as said face plate is being deformed as it moves over said projection.

2. An enclosure as in claim 1 wherein said substantially rigid wall comprises:

integral reinforcing means between said base plate and said substantially rigid wall to stabilize said substantially rigid wall during said deformation of said face plate.

3. An enclosure as in claim 1 and further comprising:

integral reinforcing means between said sidewall and said face plate for adding rigidity to said sidewall.

4. An enclosure as in claim 3 and further comprising:

retaining means for retaining said projection in place after said projection has passed through said opening.

5. An enclosure as in claim 4 and further comprising:

integral reinforcing means between said base plate and said wall to stabilize said wall during said deformation of said face plate.

6. An enclosure as in claim 1 and further comprising:

another portion of said locking means comprises first abutment means integral with said cover in contact with second abutment means integral with said wall.

7. An enclosure as in claim 6 and further comprising:

retaining means for retaining said projection in place after it has passed through said opening.

8. An enclosure as in claim 7 wherein said retaining means comprises:

a flange portion on said projection in contact with a portion of said face plate defining said opening.

9. An enclosure as in claim 8 and further comprising:

integral reinforcing means between said base plate and said wall to stabilize said wall during said deformation of said face plate; and integral reinforcing means between said sidewall and said face plate for adding rigidity to said sidewall.

10. An enclosure as in claim 1 wherein said substantially rigid wall comprises:

said base plate and said substantially rigid wall being formed from a material more rigid than said deformable material of said cover.

11. An enclosure as in claim 10 wherein said locking means also comprise:

first abutment means integral with said cover in contact with second abutment means integral with said wall;

integral reinforcing means between said base plate and said wall to stabilize said wall during said deformation of said face plate;

integral reinforcing means between said sidewall and said face plate for adding rigidity to said sidewall; and retaining means for retaining said sidewall in place after said projection has passed through said opening.

12. An enclosure as in claim 1 and further comprising:

said projection having an opening extending therethrough so that a portion of a tamper indicating sealing device may be passed therethrough.

* * * * *